United States Patent [19]

Bampton

[11] Patent Number: 4,490,188

[45] Date of Patent: Dec. 25, 1984

[54] METHOD OF IMPARTING A FINE GRAIN STRUCTURE TO 2000 & 7000 SERIES ALUMINUM ALLOYS

[75] Inventor: Clifford C. Bampton, Thousand Oaks, Calif.

[73] Assignee: Rockwell International Corporation, El Segundo, Calif.

[21] Appl. No.: 280,198

[22] Filed: Jul. 6, 1981

[51] Int. Cl.[3] ..... C22F 1/04

[52] U.S. Cl. ..... 148/12.7 A

[58] Field of Search ..... 148/12.7 A

[56] References Cited

U.S. PATENT DOCUMENTS 4,092,181 5/1978 Paton et al. ..... 148/12.7 A

*Primary Examiner*—R. Dean

*Attorney, Agent, or Firm*—H. Fredrick Hamann; Craig O. Malin

[57] ABSTRACT

A method is provided for obtaining a fine grain structure in 2000 and 7000 series aluminum alloys. The alloy is solution treated and overaged to provide a suitable precipitate. It is then softened and stabilized so that it can be cold rolled at room temperature without cracking. After cold rolling, the alloy is held at a recrystallization temperature so that new grains are nucleated and grow to form a fine grain structure.

6 Claims, 1 Drawing Figure

METHOD OF IMPARTING A FINE GRAIN STRUCTURE TO 2000 & 7000 SERIES ALUMINUM ALLOYS

BACKGROUND OF THE INVENTION

This invention relates to the field of metallurgy, and particularly to the field of processing precipitation hardenable aluminum alloys.

A fine grain structure tends to improve the formability of aluminum alloys and allows them to be formed under superplastic conditions. However, grain refinement is difficult to achieve in aluminum alloys, and attempts to obtain a fine grain structure by conventional mechanical working and heating have resulted in the material recrystallizing to the original coarse grain structure.

U.S. Pat. No. 4,092,181 to Paton and Hamilton describes a method of imparting a fine grain structure to precipitation hardening aluminum alloys. The present invention is an improvement of the earlier patented method in that it describes additional features which are useful in obtaining a fine grain structure under certain production conditions.

SUMMARY OF THE INVENTION

It is an objective of the invention to provide an improved method for refining the grain structure of 2000 and 7000 series aluminum alloys.

It is an objective of the invention to provide a method for refining the grain structure of 2000 and 7000 series aluminum alloys which uses room temperature deformation rather than elevated temperature deformation to provide the strain energy needed for recrystallization.

It is an objective of the invention to provide an economical and convenient method for refining the grain structure of 2000 and 7000 series aluminum alloys.

It is an objective of the invention to provide a method for producing high quality, fine grain 2000 and 7000 series aluminum alloys having a cold rolled surface.

According to the invention, a 2000 or 7000 series aluminum alloy is first heated to a solid solution temperature to dissolve precipitating constituents in the alloy. The alloy is then cooled to below the solution temperature and overaged by heating it above its normal precipitation hardening temperature, but below its solution temperature. This overaging treatment forms precipitates throughout the material.

After overaging, the alloy is softened so that it can be cold rolled without splitting. The overaged material may be cooled from the overaging temperature directly to the softening temperature, or it may be cooled to room temperature and stored or subjected to additional minor processing such as shearing prior to softening. For 2000 series aluminum alloys, the softening treatment comprises slow cooling (50° F. per hour maximum) the alloy from its overaging temperature of at least 750° F. to below 500° F. For 7000 series aluminum alloys, the softening treatment comprises heating the alloy at 450° F. for at least 10 hours.

After softening, the alloys can be cold worked at room temperature without cracking or splitting. The alloy is cold worked sufficient to provide the lattice strain necessary for recrystallization. Recrystallization is finally accomplished by heating the cold worked material to a temperature above its minimum recrystallization temperature.

These and other objects and features of the invention will be apparent from the following detailed description.

DESCRIPTION OF THE PREFERRED EMBODIMENT

Figure 1:
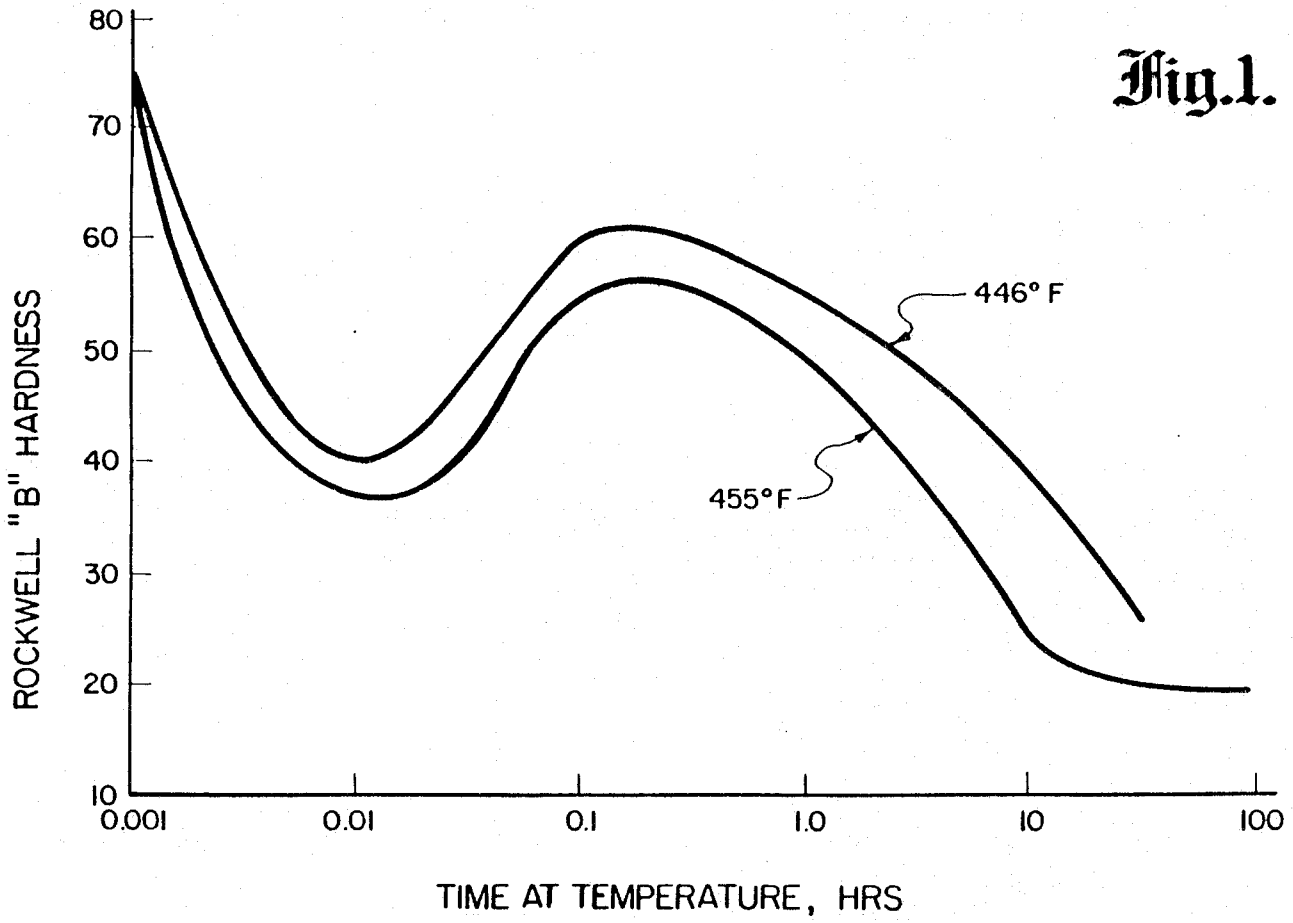
FIG. 1 shows the relation between the hold time at two different softening temperatures and the hardness of 7075 aluminum alloy.

The invention applied to 2000 series aluminum alloys such as alloy 2014, alloy 2017, alloy 2020, alloy 2219, and to 7000 series aluminum alloys such as alloy 7075 and alloy 7079.

The alloy is first solution treated in the conventional manner as would be done prior to precipitation hardening. This treatment dissolves at least some of the precipitating ingredients and leaves the alloy in a coarse-grained condition. Instead of being followed by the standard precipitation hardening treatment (an aging treatment which produces a fine distribution of precipitates spaced 100 to 500 Å apart suitable for increasing the strength of the alloy), the alloy is subjected to a precipitation treatment at a temperature higher than the temperature used during the standard precipitation treatment. This is an overaging treatment which produces a somewhat coarser distribution of precipitates spaced approximately 5,000 to 10,000 Å apart, as described in U.S. Pat. No. 4,092,181 Depending upon the duration of aging, a temperature as low as about 350° F. can be used for the 2000 series alloys and as low as 600° F. for the 7000 series alloys. However, an aging temperature of about 750° F. for about 8 hours is preferred for both these series of alloys.

In order to recrystallize the alloy, it must be plastically deformed (work hardened) a sufficient amount to provide the lattice strain energy needed for recrystallization. As known in the industry, plastic deformation can be accomplished by rolling, by extrusion, by drawing, and by forging to produce various products such as plate, bar, sheet, wire, forgings, etc.

Lattice strain energy can be introduced into a material by working it at room temperature in a process such as by cold rolling or by working it at moderately elevated temperatures such as by warm rolling. For many applications, room temperature working is advantageous because: (1) room temperature working is cheaper and is easier to control because the material does not have to be maintained in a restricted elevated temperature range, (2) a superior finish may be obtained especially if the material is caustic etched prior to working in order to remove any prior hot rolling surface defects, (3) the material can be handled easily during forming when operations such as shearing and cross-rolling are required, and (4) more energy can be stored in the material by room temperature working rather than by elevated temperature working because at high temperatures dynamic recovery and recrystallization during the deformation operation removes, or anneals out, the strain energy.

Unfortunately, it was not possible to cold roll the 2000 and 7000 series aluminum alloys after the overaging treatment because of excessive cracking of the rolling stock. Considerable room temperature aging occurs in the 2000 series and 7000 series aluminum alloys after the overaging treatment. Although the overaging temperature is below the solution heat treatment temperature, it is still sufficiently high to produce significant supersaturation of the solute elements when cooled to room temperature. This supersaturation is removed by subsequent precipitation and growth of Guinier-Preston (G-P) zones at room temperature. The room temperature precipitation hardening continues for many days, but significant hardening occurs within the first 24 hours. For example, the hardness of 7075 alloy increases from Rockwell B28 as quenched from the 750° F. overaging treatment to Rockwell B 62 after 24 hours at room temperature. The 2000 series alloys harden even faster at room temperature.

The G-P zones developed by room temperature aging lead to very poor cold rollability because they cause a high yield stress and highly localized shear bands after relatively small amounts of plastic deformation. Consequently, critical cracks form in cold-rolled material at low strains.

If the material is cold rolled immediately after quenching from the overaging temperature in order to avoid the above-mentioned room temperature aging, excessive cracking still occurs. Apparently the high solute supersaturation causes high matrix flow stresses, and these high stresses are concentrated at the overaged particles. These stress concentrations cause early ductile failure.

In work leading to the present invention, it was discovered that the material can be made ductile (softened) by a second aging treatment which removes both the solute supersaturation and the G-P zones. Importantly, this softening step did not inhibit the formation of a fine grain after the final recrystallization treatment. In fact, because the material was soft and ductile enough to be cold rolled rather than hot rolled, greater strain energy was introduced into the material and an even finer grain could be obtained.

For the 2000 series alloys, the softening step consists of slow cooling the material from approximately 750° F. to below approximately 500° F. The cooling rate should be slower than 50° F. per hour. It is frequently convenient to slow cool the alloy directly from the overaging treatment. However, material which has been cooled to (and even held at) room temperature after the overaging treatment can be reheated to 750° F. and softened by slow cooling.

For the 7000 series alloys, the softening step consists of heating the material at approximately 455° F. for at least 10 hours. As in the case of the 2000 series alloy, it is convenient to cool the material directly from the overaging treatment to the softening temperature (455° F.). However, material which has been cooled to room temperature after the overaging treatment can be reheated to the 455° F. softening temperature.

FIG. 1 is a curve showing the effect of hold time at two different softening temperatures on the hardness of 7075 alloy which had been overaged previously at 750° F., water quenched, and held at room temperature for three months prior to softening. As shown in FIG. 1, minimum softness is obtained by holding the material at 455° F. for about 24 hours.

The following examples are illustrative of the invention as applied to a 2000 series alloy (2024) and to a 7000 series alloy (7075).

EXAMPLE I—Aluminum Alloy 2024

Alloy 2024 is a precipitation hardening aluminum base alloy having a nominal composition of: 4.5% Cu, 1.5% Mg, and 0.6% Mn. Samples of the alloy were solution treated at 920° F. for 3 hours and water quenched. They were then overaged at 750° F. for 8 hours in accordance with the teaching in U.S. Pat. No. 4,092,181. However, prior to plastically deforming the alloy, a softening treatment was applied to the samples so that they could be rolled at room temperature rather than at an elevated temperature.

To soften the samples in preparation for cold rolling, they were slow cooled from the 750° F. overaging temperature to 390° F. The cooling rate actually used was 18° F. per hour, although cooling rates as fast as 50° F. per hour should also be acceptable. The samples were air cooled to room temperature from the 390° F. temperature although any cooling rate below 500° F. should be acceptable.

The overaged and softened samples were cold rolled to reductions in cross-sectional areas of 50%, 70%, and 90%. The cold-rolled material was then heated rapidly to 920° F. , causing it to recrystallize into a fine grain structure. The grain size obtained in the longitudinal (L) and in the short transverse (ST) direction was much smaller than the original grain size (over 100 μm) and was finest for the most severely worked material, as shown below:

| % Reduction in Thickness by Cold Rolling | Grain Size, μm | |
|---|---|---|
| | L | ST |
| 50 | 20 | 13 |
| 70 | 14 | 10.5 |
| 90 | 9 | 7.5 |

EXAMPLE II—Aluminum Alloy 7075

Alloy 7075 is a precipitation hardening aluminum base alloy having a nominal composition of: 5.5% Zn, 2.5% Mg, 1.5% Cu, and 0.3% Cr. Samples were solution treated for one hour at 900° F. and cold-water quenched. The samples were then overaged for 8 hours at 750° F. and either water quenched or air cooled to room temperature. For comparison purposes, the samples were then divided into two groups. The first group continued the processing described in U.S. Pat. No. 4,092,181 by warm rolling the overaged samples at 430° F. for 74% and 94% reduction in cross sectional areas. These warm rolled samples were recrystallized by heating them to 900° F.

The second group of samples were not warm rolled after the overaging treatment. Rather, they were given a softening treatment by reheating them to 455° F. and holding them for 24 hours. This softened the samples so that they could be cold rolled (rolled at room temperature) up to 94% reduction in thickness. Finally, the cold rolled samples were recrystallized by heating them rapidly to 900° F.

As shown below, both groups of samples had a much smaller recrystallized grain structure than the original grain structure of over 100 μm. The grain structure of the samples processed by cold rolling according to the present invention was smaller than the grain structure of the samples processed by warm rolling, apparently because cold rolling produces more plastic strain energy than warm rolling.

| Rolling Temperature | % Reduction in Thickness | Grain Size, μm | |
|---|---|---|---|
| | | L | ST |
| 430 F. | 74 | 14 | 11 |

-continued

| Rolling Temperature | % Reduction in Thickness | Grain Size, μm L | Grain Size, μm ST |
|---|---|---|---|
| 430 F. | 94 | 11 | 6 |
| Room | 74 | 11 | 7 |
| Room | 94 | 8 | 6 |

Numerous variations and modifications can be made without departing from the invention. Accordingly, it should be clearly understood that the form of the invention described above is illustrative only and is not intended to limit the scope of the invention.

What is claimed is:

1. An improvement in a method of imparting a fine grain structure to an aluminum alloy, said method having steps of:

providing an aluminum alloy selected from the group consisting of 2000 and 7000 series aluminum alloys having a precipitating constituent;

dissolving at least some of said precipitating constituent in said alloy by heating said alloy to a solid solution temperature;

cooling said alloy to a temperature below said solid solution temperature;

overaging said alloy at an overaging temperature to form precipitates;

plastically straining said alloy; and recrystallizing said alloy by heating it above its minimum recrystallization temperature, whereby said precipitates form nuclei for the recrystallization and controlled growth of a fine grain structure;

said improvement being characterized by the addition of a softening step after said overaging step, said softening step comprising heating said alloy below said overaging temperature;

and being further characterized in that said step of plastically straining said alloy comprising plastically straining said alloy at approximately room temperature.

2. The improvement as claimed in claim 1 wherein said step of providing an aluminum alloy comprises providing a 2000 series aluminum alloy; and said softening step comprises slow cooling said 2000 series aluminum alloy from below said overaging temperature to below approximately 500° F.

3. The method as claimed in claim 2, wherein said slow cooling comprises cooling at a rate of approximately 50° F. per hour maximum.

4. The method as claimed in claim 1, wherein said step of providing an aluminum alloy comprises providing a 7000 series aluminum alloy; and said softening step comprises heating said 7000 series aluminum alloy at approximately 455° F. for at least 10 hours.

5. An improvement in a method of imparting a fine grain structure to a 7000 series aluminum alloy, said method having steps of:

providing a 7000 series aluminum alloy having a precipitating constituent;

dissolving at least some of said precipitating constituent in said alloy by heating said alloy to a solid solution temperature;

cooling said alloy to a temperature below said solid solution temperature;

overaging said alloy to form precipitates;

plastically straining said alloy; and recrystallizing said alloy by heating it above its minimum recrystallization temperature, whereby said precipitates form nuclei for the recrystallization and controlled growth of a fine grain structure;

said improvement being characterized by the addition of a softening step after said overaging step, said softening step comprising heating said alloy at approximately 455° F. for at least 10 hours.

6. An improvement in a method of imparting a fine grain structure to a 2000 series aluminum alloy, said method having steps of:

providing a 2000 series aluminum alloy having a precipitating constituent;

dissolving at least some of said precipitating constituent in said alloy by heating said alloy to a solid solution temperature;

cooling said alloy to a temperature below said solid solution temperature;

overaging said alloy at an overaging temperature to form precipitates;

plastically straining said alloy; and recrystallizing said alloy by heating it above its minimum recrystallization temperature, whereby said precipitates form nuclei for the recrystallization and controlled grain growth of a fine grain structure;

said improvement being characterized by the addition of a softening step after said overaging step, said softening step comprising cooling said alloy from about 750° F. to below approximately 500° F. at a rate of approximately 50° F. per hour maximum.

* * * * *